US009766597B2

(12) United States Patent
Fujisawa et al.

(10) Patent No.: US 9,766,597 B2
(45) Date of Patent: Sep. 19, 2017

(54) ELECTRONIC TIMEPIECE

(71) Applicant: Seiko Epson Corporation, Tokyo (JP)

(72) Inventors: Teruhiko Fujisawa, Shiojiri (JP); Shuichi Tamura, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/350,401

(22) Filed: Nov. 14, 2016

(65) Prior Publication Data

US 2017/0060099 A1 Mar. 2, 2017

Related U.S. Application Data

(63) Continuation of application No. 14/931,045, filed on Nov. 3, 2015, now Pat. No. 9,523,963.

(30) Foreign Application Priority Data

Dec. 4, 2014 (JP) ..... 2014-246220

(51) Int. Cl.
*G04G 17/04* (2006.01)
*G04R 20/02* (2013.01)
*G04R 60/12* (2013.01)

(52) U.S. Cl.
CPC ..... *G04G 17/04* (2013.01); *G04R 20/02* (2013.01); *G04R 60/12* (2013.01)

(58) Field of Classification Search
CPC ..... G04G 17/04; G04G 21/04; G04R 20/02; G04R 60/12; G04C 9/08; G04C 9/02
See application file for complete search history.

(56) References Cited

U.S. PATENT DOCUMENTS

| | | | | |
|---|---|---|---|---|
| 8,467,272 | B2 | 6/2013 | Fujisawa | |
| 8,493,817 | B2 | 7/2013 | Baba | |
| 8,562,207 | B2 | 10/2013 | Matsuzaki | |
| 8,570,840 | B2 | 10/2013 | Fujisawa | |
| 8,755,253 | B2 | 6/2014 | Fujisawa | |
| 8,804,466 | B2 * | 8/2014 | Matsuzaki | G04R 60/12 368/278 |
| 8,942,068 | B2 | 1/2015 | Fujisawa | |
| 2004/0004909 | A1 * | 1/2004 | Fujimori | G04R 60/10 368/204 |
| 2006/0153009 | A1 * | 7/2006 | Matoge | G04R 60/12 368/47 |
| 2006/0227058 | A1 * | 10/2006 | Zellweger | H01Q 1/273 343/718 |

(Continued)

FOREIGN PATENT DOCUMENTS

| | | |
|---|---|---|
| JP | 2010-096707 A | 4/2010 |
| JP | 2012-013627 A | 1/2012 |

(Continued)

*Primary Examiner* — Sean Kayes
(74) *Attorney, Agent, or Firm* — Harness, Dickey & Pierce, P.L.C.

(57) ABSTRACT

An electronic timepiece has a time display unit including a dial made from a non-conductive material, and hands; and a movement that drives the hands. The movement includes a circuit board, a planar antenna attached to the circuit board, a stepper motor that drives the hands, and a battery. The planar antenna, the stepper motor, and the battery are disposed to positions overlapping the time display unit in plan view, and not overlapping each other in plan view.

11 Claims, 15 Drawing Sheets

(56) References Cited

U.S. PATENT DOCUMENTS

| | | | | |
|---|---|---|---|---|
| 2011/0051561 | A1 | 3/2011 | Fujisawa | |
| 2011/0128824 | A1 | 6/2011 | Downey et al. | |
| 2013/0235703 | A1* | 9/2013 | Fujisawa ..... | G04G 5/002 368/28 |

FOREIGN PATENT DOCUMENTS

| | | | |
|---|---|---|---|
| JP | 2012-163516 | A | 8/2012 |
| JP | 2012-198150 | A | 10/2012 |

* cited by examiner

ELECTRONIC TIMEPIECE

CROSS-REFERENCE TO RELATED APPLICATIONS

This is a continuation application of U.S. patent application Ser. No. 14/931,045 filed Nov. 3, 2015, which claims priority to Japanese Patent Application No. 2014-246220, filed Dec. 4, 2014, both of which are expressly incorporated by reference herein in their entireties.

BACKGROUND

1. Technical Field

The present invention relates to an electronic timepiece, and relates more particularly to an electronic timepiece with a planar antenna.

2. Related Art

JP-A-2012-13627 describes an electronic timepiece with a planar antenna for receiving radio frequency signals transmitted from GPS (Global Positioning System) or other types of positioning information satellites.

The electronic timepiece in JP-A-2012-13627 has a planar antenna disposed on the back cover side of the dial, and suppresses loss of antenna sensitivity by separating the planar antenna from the metal case around the antenna.

In the electronic timepiece taught in JP-A-2012-13627, the planar antenna and the battery are disposed overlapping in plan view with the circuit board therebetween. This increases the thickness of the electronic timepiece. Planar antennae used in small electronic timepieces such as wristwatches are limited in size, however, and therefore generally use a dielectric to achieve a wavelength shortening effect. The thickness of the dielectric is therefore added to the thickness of the planar antenna, and when the planar antenna and battery are stacked one above the other, the thickness of the electronic timepiece increases.

An electronic timepiece according to the invention enables reducing the thickness of the timepiece while maintaining good reception performance.

SUMMARY

An electronic timepiece according to one aspect of the invention has a time display unit including a dial made from a non-conductive material, and hands; and a movement that drives the hands. The movement includes a circuit board, a planar antenna attached to the circuit board, a motor that drives the hands, and a battery. The planar antenna, the motor, and the battery disposed overlapping the time display unit in plan view, and not overlapping each other in plan view.

Because the planar antenna, motor, and battery in the electronic timepiece according to the invention are disposed to positions not overlapping each other in plan view, the timepiece can be made thinner than when the planar antenna or motor and the battery are located one above the other in the thickness direction of the timepiece (that is, overlapping in plan view).

Furthermore, because the planar antenna, motors, and battery are also disposed at positions superimposed with the dial and the hands of the time display unit in plan view, the plane size of the electronic timepiece can be easily reduced compared with a configuration having the planar antenna, motor, and battery outside of the footprint of the time display unit in plan view.

Furthermore, because the planar antenna can be disposed without overlapping the motor and battery in plan view, the planar antenna can be stacked on a dielectric substrate. As a result, good reception performance can be assured using a planar antenna with a small planar size enabling incorporation in a wristwatch size electronic timepiece. Furthermore, while the planar antenna overlaps the time display unit including a dial and hands in plan view, the reception performance of the planar antenna can be assured because the dial is made from a non-conductive material. The effect of the hands on reception performance can also be minimized even if the reception process is executed at a position where hands overlap the planar antenna even if the hands are made of a conductive material because the planar area of the hands is small.

Reception performance can therefore be assured, and a thin electronic timepiece suitable as a wristwatch can be provided.

In an electronic timepiece according to another aspect of the invention, the hands include an hour hand, minute hand, and second hand; and a hole through which the pivots of the hour hand, minute hand, and second hand pass is formed in the planar center of the dial.

Thus comprised, reception performance can be assured and a thinner, smaller design is possible in a typical analog timepiece having the pivots of the hour hand, minute hand, and second hand in the planar center of the dial.

Further preferably in an electronic timepiece according to another aspect of the invention, the area overlapping the time display unit in plan view is divided into two areas, a first area and a second area, by a line through the planar center of the planar antenna and the planar center of the battery; and the motor includes a first motor disposed in the first area, and a second motor disposed in the second area.

Thus comprised, because the motors are distributed in a first area and second area when there are two motors, a first motor and second motor, plural motors can be arranged in a well-balanced configuration, and the layout of the planar antenna, battery, and motor can be simplified. Furthermore, because first motor and second motor are disposed between the planar antenna and battery, the planar antenna and battery can be separated, and good reception performance can be easily assured in the planar antenna.

When there are three or more motors, the motors may be desirably distributed between the first area and second area. If there is an even number of motors, the same number of motors is preferably disposed in each area. If there is an odd number of motors, the motors are preferably arranged so that there is one more motor in one area than the other. This enables disposing the motors in a well-balanced configuration.

Further preferably in an electronic timepiece according to another aspect of the invention, the planar antenna and the battery are disposed to positions where a line through the planar center of the planar antenna and the planar center of the battery passes through the planar center of the dial.

Thus comprised, the planar antenna and battery can be disposed to positions on opposite sides of the planar center of the dial. The planar antenna and battery can thus be separated, and the reception performance of the planar antenna can be easily assured.

Further preferably in an electronic timepiece according to another aspect of the invention, a notch is formed in the circuit board; and the battery is disposed in the notch at a position not overlapping the circuit board in plan view.

Because the battery can thus be disposed in a notch in the circuit board, the thickness of the electronic timepiece can be reduced compared with a configuration having the battery on the back side (back cover side) of the circuit board, and the thickness of the timepiece can be reduced. Furthermore, because the battery does not need to be disposed to the back side of the circuit board, a thick battery can be used. As a result, a battery with a small diameter can be used, the battery can be disposed to a position not overlapping the planar antenna or motor in plan view, and the size of the timepiece can be reduced.

Further preferably in an electronic timepiece according to another aspect of the invention, the movement includes a wheel train that transfers drive power from the motor to the hands; and the battery is disposed to a position not overlapping the wheel train in plan view.

Thus comprised, the battery can be disposed to a position not overlapping the planar antenna, motor, or wheel train of the movement in plan view, and a thick battery can therefore be used. A battery with a small diameter can therefore be used, and the size of the timepiece can be reduced even if the battery is disposed to a position not overlapping the planar antenna, motor, and wheel train in plan view.

Further preferably in an electronic timepiece according to another aspect of the invention, the movement includes pivots to which the hands are attached, and a wheel train bridge that supports the pivots; and a metal part is disposed on the back cover side of the wheel train bridge.

Thus comprised, the pivot to which the hands are attached and the battery do not overlap in plan view, and metal parts such as the magnetic shield and circuit cover can be disposed on the back side of the wheel train bridge that supports the pivots. As a result, when the hands are pressed onto the pivot, the force applied to the pivot can be supported through the wheel train bridge by the metal parts, and the hands can be consistently installed to the desirable positions.

Further preferably in an electronic timepiece according to another aspect of the invention, the movement has a plurality of pivots disposed at different positions in plan view; and the pivots are disposed to positions not overlapping the planar antenna and battery in plan view.

Because plural pivots disposed to the center of the time display unit and the center of a subdial are not at the same planar positions as the planar antenna and battery in this aspect of the invention, metal parts such as a magnetic shield and circuit cover can be disposed on the back side of the wheel train bridge that supports the pivots. As a result, the force applied to the pivots when pushing the hands onto the pivots can be supported by metal parts through the wheel train bridge, and the hands can be consistently and reliably installed even when there are multiple pivots.

Further preferably in an electronic timepiece according to another aspect of the invention, the area overlapping the time display unit in plan view is divided by two lines through the planar center of the time display unit into four fan-shaped areas, first fan-shaped area to fourth fan-shaped area; the planar antenna is disposed in the first fan-shaped area; the two lines are set to positions making the first fan-shaped area the smallest size capable of containing all of the planar antenna; and the planar center of the battery is disposed in the third fan-shaped area, which is located on the opposite side of the center of the time display unit as the first fan-shaped area.

Thus comprised, the planar antenna and battery can be separated in a first fan-shaped area and third fan-shaped area opposite each other with the center of the time display unit therebetween, and the motors can be disposed in the other two areas. Space inside the movement can therefore be used effectively.

Further preferably in an electronic timepiece according to another aspect of the invention, the planar antenna is attached to the surface of the circuit board; and a receiver element that processes signals received by the planar antenna is attached to the back side of the circuit board.

Because the circuit board is between the receiver element and the planar antenna, and the circuit board can be used as a ground plane conductive of the ground of the planar antenna in this aspect of the invention, signal noise produced by the receiver element can be prevented from affecting signal reception by the planar antenna. The reception performance of the planar antenna can therefore be improved.

Further preferably in an electronic timepiece according to another aspect of the invention, the planar antenna is attached to the surface of the circuit board; and a control chip of the electronic timepiece is attached to the back of the circuit board in one of two areas delineated by a line through the planar center of the planar antenna and the planar center of the battery, and a power supply chip is disposed in the other area.

Thus comprised, the control chip and power supply chip, which are relatively large compared with other components of a wristwatch, can be distributed on the back side of the circuit board. As a result, there is no need to dispose IC chips on the face side of the circuit board, and the space where the planar antenna, motor, and wheel train are located on the face side of the circuit can be used effectively.

Furthermore, because parts are not usually disposed between the back of the circuit board and the back cover, the receiver element, control chip, and power supply chip can be easily disposed in this space.

Further preferably in an electronic timepiece according to another aspect of the invention, the movement is housed in an outside case of which at least part is metal; and a ring member made from a non-conductive material is disposed around the outside circumference of the dial.

The apparent quality of the electronic timepiece can be improved with this configuration because at least part of the outside case, such as the main body and back cover, can be made from metal. Furthermore, because the dial ring or other ring-shaped member disposed along the outside circumference of the dial can be made from a non-conductive material, the planar antenna can receive signals from the crystal side of the timepiece through the dial and ring member, and good reception can be assured even when the body and back cover of the case are metal.

Further preferably in an electronic timepiece according to another aspect of the invention, a subdial is disposed to the dial at a position not overlapping the planar antenna in plan view.

Because a subdial is located at a position not overlapping the planar antenna in plan view with this configuration, metal parts can be used for the markers of the subdial, for example, and the design can be improved.

Other objects and attainments together with a fuller understanding of the invention will become apparent and appreciated by referring to the following description and claims taken in conjunction with the accompanying drawings.

DESCRIPTION OF EMBODIMENTS

Embodiment 1

A first embodiment of the invention is described below. Note that the crystal 31 side of the electronic timepiece 1 according to this embodiment of the invention is also referred to as the face, front, or top side, and the back cover 12 side is also referred to as the back or bottom side of the electronic timepiece 1.

Figure 1:
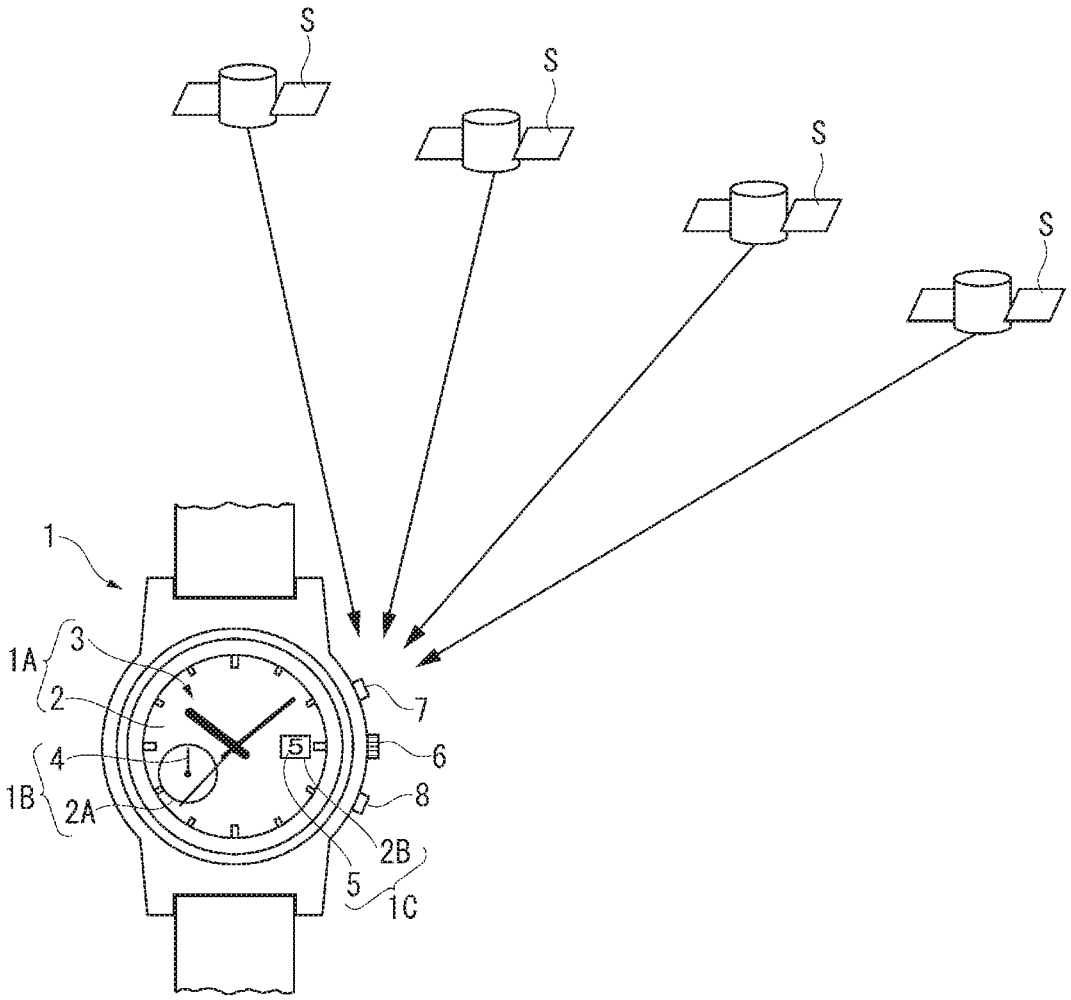
FIG. 1 illustrates an electronic timepiece according to a first embodiment of the invention.
Figure 2:
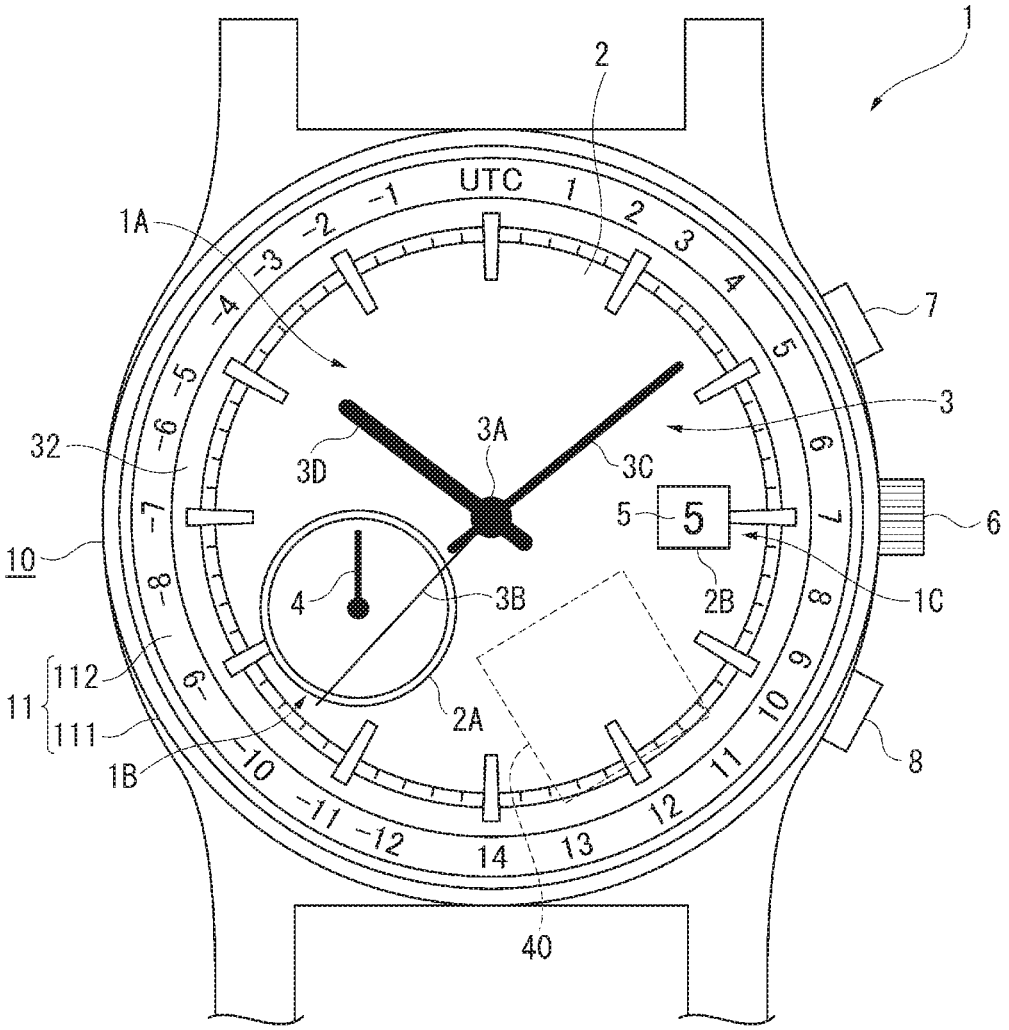
FIG. 2 is a plan view of the electronic timepiece.

As shown in FIG. 1 and FIG. 2, the electronic timepiece 1 is a wristwatch with a time display unit 1A for displaying the time using a dial 2 and hands 3, an information display unit 1B including a subdial 2A of the dial 2 and a hand 4, and a calendar display unit 1C including a window 2B in the dial 2 and a date wheel 5.

The dial 2 is a disc-shaped member made of polycarbonate or other non-conductive material. The subdial 2A is located at 8:00 on the dial 2, and the window 2B is located at 3:00 on the dial 2. In addition to the subdial 2A and window 2B, the dial 2 has a through-hole 2C through which the center pivot 3A of the hands 3 passes, and a through-hole 2D through which the pivot 4A of the small hand 4 passes, as shown in FIG. 3 and FIG. 4.

Through-hole 2C is formed in the plane center of the dial 2, and through-hole 2D is formed on or near a line between the through-hole 2C and the marker denoting 8:00 on the dial 2.

Figure 3:
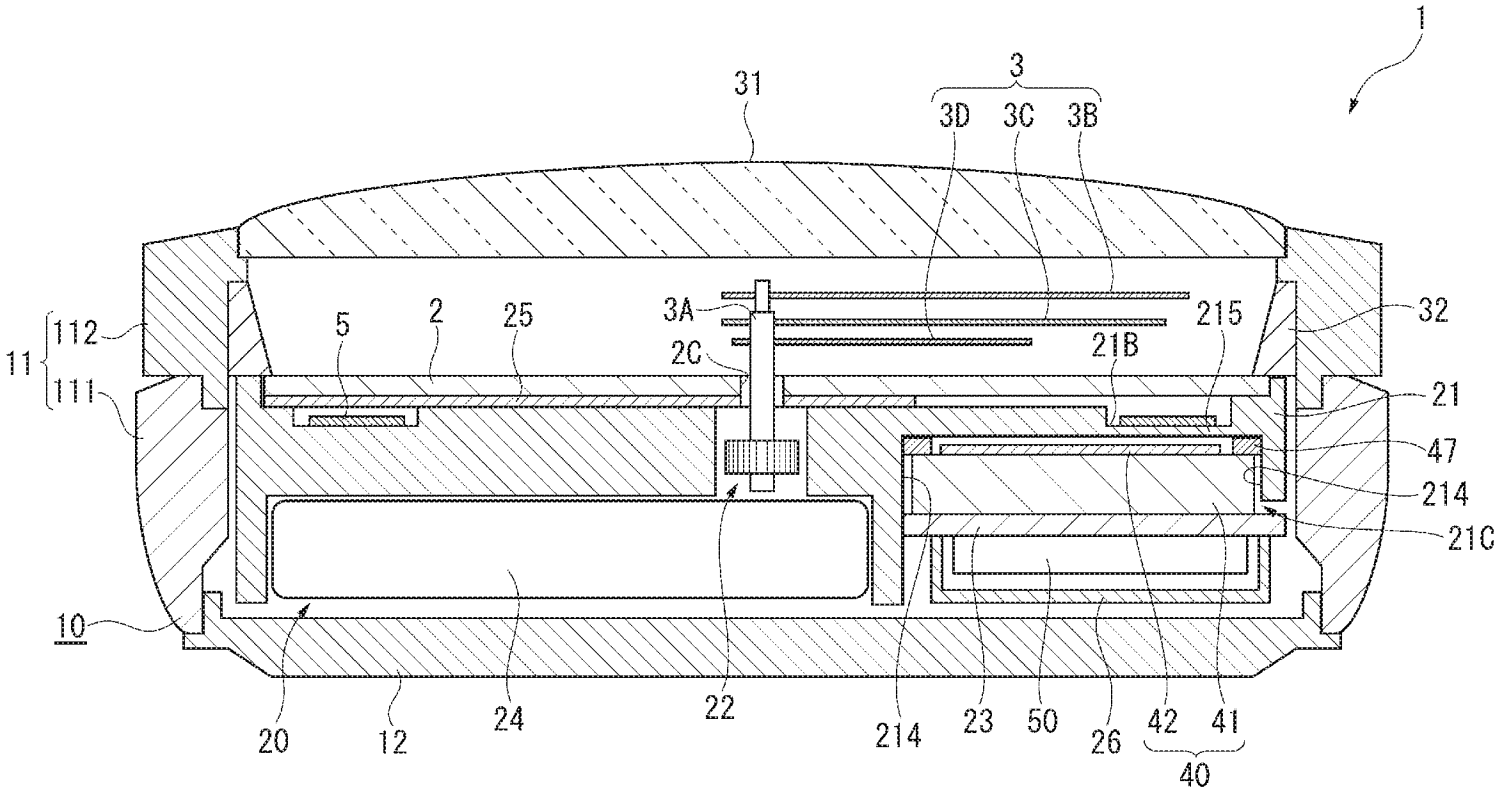
FIG. 3 is a section view of the electronic timepiece.
Figure 4:
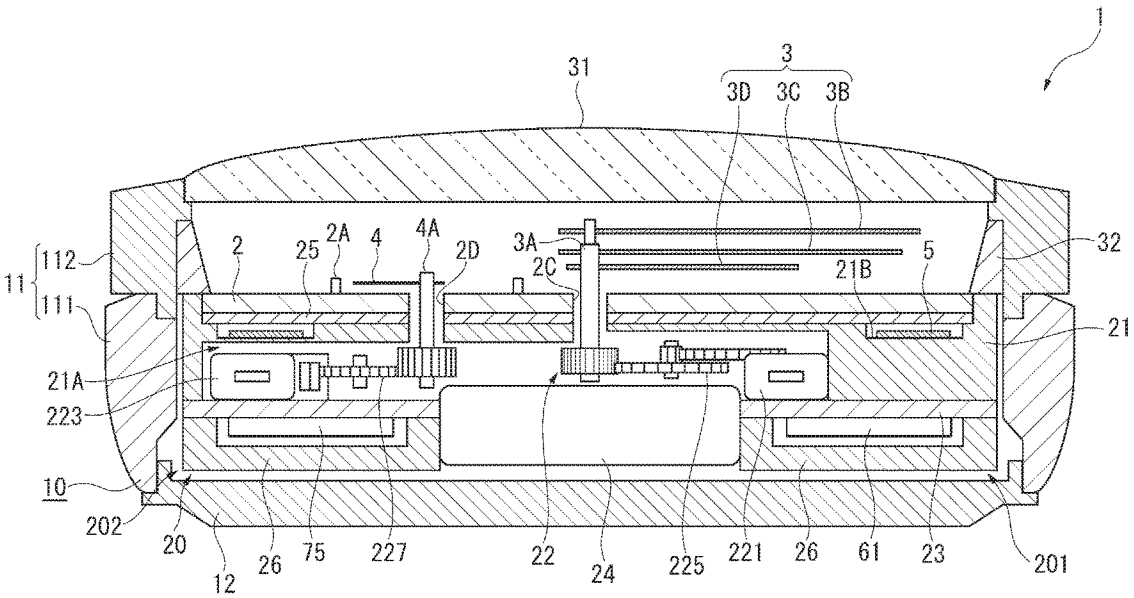
FIG. 4 is a section view of the electronic timepiece.

FIG. 3 is a section view through a line between the 5:00 and 11:00 positions on the dial 2, and FIG. 4 is a section view through a line between 2:00 and 8:00 on the dial 2.

The information display unit 1B comprising the subdial 2A and hand 4 (small hand) displays information such as the current operating mode of the timepiece, the day of the week, or reserve power, for example.

The hands 3 include a second hand 3B, minute hand 3C, and hour hand 3D. The hands 3, 4 and date wheel 5 are driven by stepper motors 221 to 224 through wheel trains 225, 227, and 228 as described further below.

As shown in FIG. 2, the electronic timepiece 1 also has a crown 6 and buttons 7 and 8 as external operating members.

The electronic timepiece 1 receives satellite signals and acquires satellite time information from the plural GPS satellites S orbiting the Earth on known orbits, and can correct internal time information based on the acquired satellite time information.

Note that the GPS satellites S shown in FIG. 1 are just one example of positioning information satellites, and numerous GPS satellites S are in orbit. There are presently approximately 30 GPS satellites S in service.

External Structure of the Electronic Timepiece

As shown in FIG. 2, FIG. 3, and FIG. 4, the electronic timepiece 1 has an external case 10 that houses a movement 20 described further below. The case 10 includes the main case 11, and the back cover 12.

The main case 11 includes a tubular case member 111, and a bezel 112 disposed on the front side of the case member 111.

The bezel 112 is shaped like a ring. The bezel 112 and case member 111 are connected by an interlocking tongue-and-groove structure formed on their mutual opposing surfaces, or by adhesive or double-sided adhesive tape, for example. The bezel 112 may also be attached so that it can rotate on the case member 111.

The crystal 31 is attached to the inside of the bezel 112 and is held by the bezel 112.

A round back cover 12 is disposed to the back of the main case 11 covering the back cover side opening to the main case 11. The back cover 12 and the outside case member 111 of the main case 11 screw together.

Note that the outside case member 111 and the back cover 12 are discrete members in this embodiment of the invention, but the invention is not so limited and the outside case member 111 and back cover 12 may be formed in unison as a single piece.

The outside case member 111, bezel 112, and back cover 12 are made of brass, stainless steel, titanium alloy, or other conductive metal material.

Internal Configuration of the Electronic Timepiece

The internal structure housed inside the outside case 10 of the electronic timepiece 1 is described next.

As shown in FIG. 2 to FIG. 5, the dial 2, movement 20, planar antenna 40 (patch antenna), date wheel 5, and dial ring 32 are housed inside the case 10.

The movement 20 includes the base plate 21, a drive module 22 supported by the base plate 21, a circuit board 23, a storage battery 24, and a solar panel 25.

The base plate 21 is made from plastic or other non-conductive material. The base plate 21 includes a drive module housing 21A that holds the drive module 22, a date wheel housing 21B where the date wheel 5 is disposed, and an antenna housing 21C that holds the planar antenna 40. The date wheel housing 21B is a ring-shaped recess formed in the surface of the base plate 21.

The drive module housing 21A and antenna housing 21C are disposed on the back side of the base plate 21. As shown in FIG. 3, the antenna housing 21C has four walls 214 (only two shown in FIG. 3) facing the four sides of the planar antenna 40, which is rectangular in plan view, and a cover part 215 opposing the front side of the planar antenna 40. The cover part 215 in this embodiment covers the entire surface of the planar antenna 40, but a through-hole superimposed in plan view with at least part of the antenna electrode 42 of the planar antenna 40 may be formed in the cover part 215. Note that the four walls 214 and the cover part 215 are formed in unison with the base plate 21.

Because the antenna housing 21C is at 5:00 on the dial 2 in plan view, the planar antenna 40 is also located at 5:00 as shown in FIG. 2. More specifically, the planar antenna 40 is located between the center pivot 3A of the hands 3 and the main case 11, and between approximately 4:00 and 6:00 on the dial 2.

The drive module 22 is held in the drive module housing 21A of the base plate 21, and drives the hands 3, 4 and date wheel 5 of the time display unit 1A, information display unit 1B, and date display unit 1C. More specifically, as shown in FIG. 4 and FIG. 6, the drive module 22 includes the first stepper motor 221 and first wheel train 225 that drive the hour hand 3D and minute hand 3C of the hands 3; the second stepper motor 222 and a second wheel train (not shown in the figure) that drive the second hand 3B of the hands 3; the third stepper motor 223 and third wheel train 227 that drive the small hand 4; and the fourth stepper motor 224 and fourth wheel train 228 (see FIG. 5) that drive the date wheel 5.

The stepper motors 221 to 224 are distributed between a first area 201 and a second area 202. The first area 201 and second area 202 overlap the time display unit 1A in plan view, and are separated by a line 200 between the plane center 401 of the planar antenna 40, and the plane center 241 of the storage battery 24.

In this embodiment of the invention the time display unit 1A is round in plan view, and line 200 passes through the plane center of the time display unit 1A, that is, the through-hole 2C. As a result, the line 200 is on the diameter of the time display unit 1A, and the first area 201 and second area 202 have substantially the same shape and area.

The first area 201 is the area from approximately the 11:00 marker and the 5:00 marker of the dial 2, and includes the window 2B. The first stepper motor 221 (first motor) that drives the hour hand 3D and minute hand 3C, and the fourth stepper motor 224 that drives the date wheel 5, are located in the first area 201.

The second area 202 is the area from approximately the 5:00 marker to the 11:00 marker of the dial 2, and includes the subdial 2A. The second stepper motor 222 (second motor) that drives the second hand 3B, and the third stepper motor 223 that drives small hand 4 of the subdial 2A, are located in the second area 202.

The storage battery 24 is therefore located in plan view at approximately 11:00 on the dial 2, and the planar antenna 40 is at approximately the 5:00 position. As shown in FIG. 6, the stem 81 of the crown 6 is located at the 3:00 position on the dial 2 in plan view, and a switching mechanism including the setting lever 82 are disposed around the stem 81.

Figure 5:
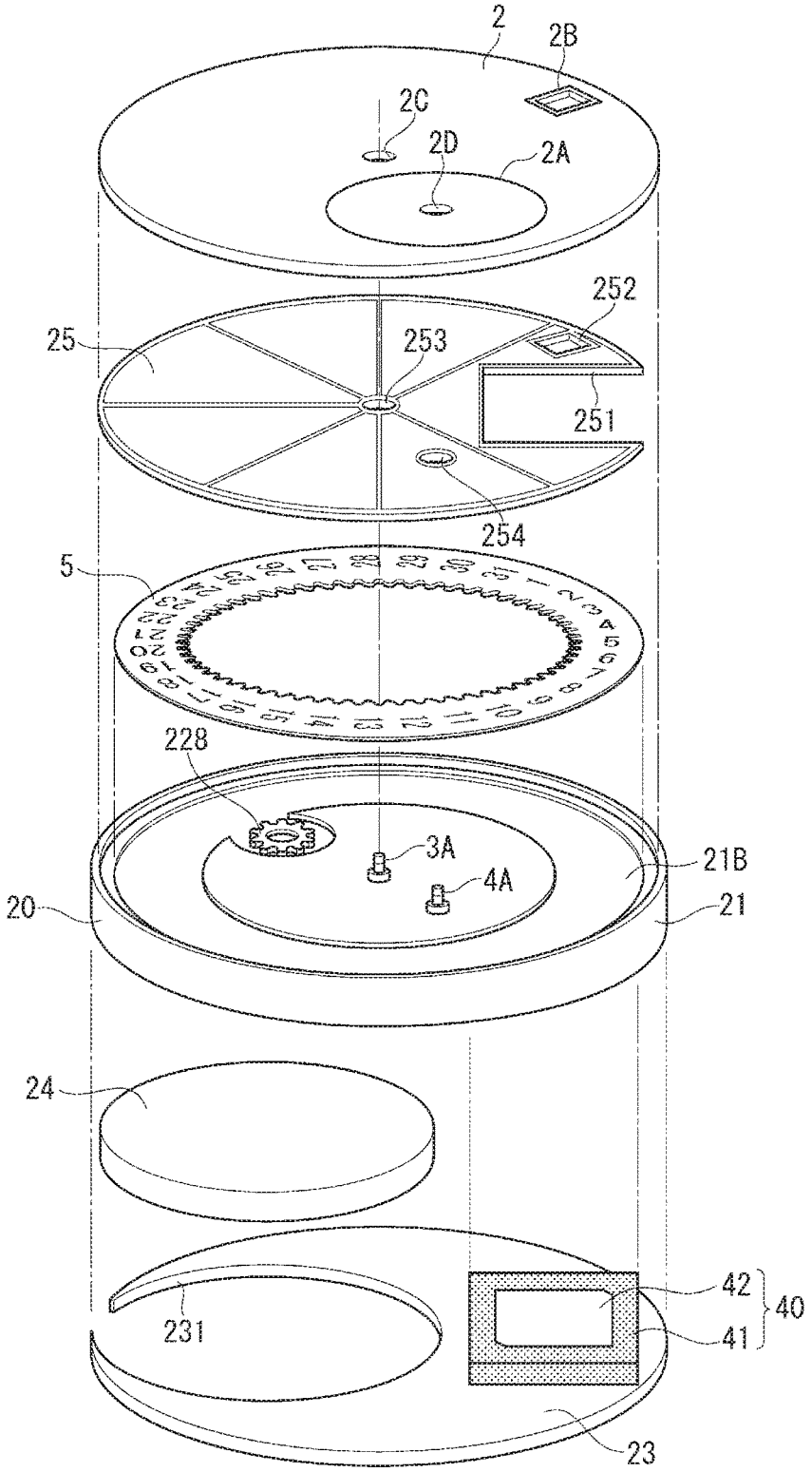
FIG. 5 is a partially exploded oblique view of the electronic timepiece.
Figure 6:
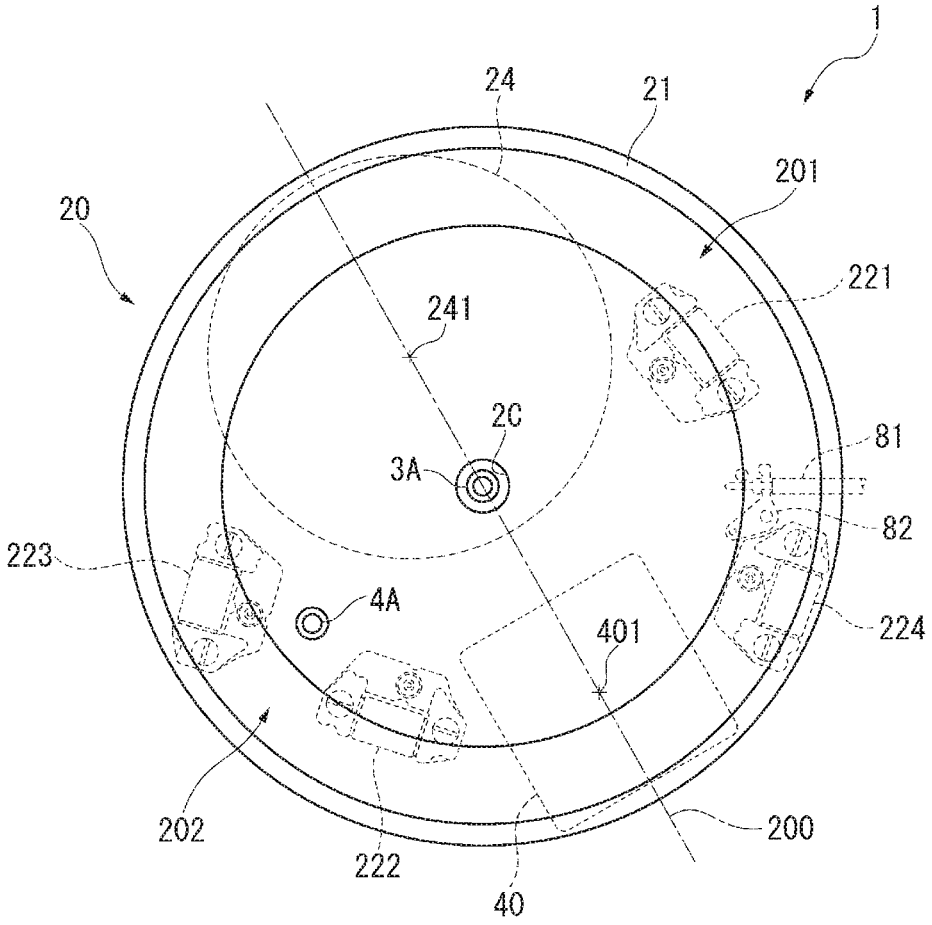
FIG. 6 is a plan view showing main parts of the movement of the electronic timepiece.

As shown in FIG. 5, the circuit board 23 is round and flat, and has a round notch 231 where the storage battery 24 is disposed. The top side of the circuit board 23, which is the surface on the dial 2 side, contacts the back side of the base plate 21, and is fastened to the base plate 21 by screw or other fastener. The planar antenna 40 is mounted on the face side of the circuit board 23. A reception module 50 (receiver element, reception chip) that processes satellite signals received from the GPS satellites S, a control unit 61 (control chip) that controls the stepper motors 221 to 224, and a power supply chip 75, are mounted on the back side of the circuit board 23.

In this embodiment of the invention the movement 20 is housed inside the metal main case 11, and radio signals are easily blocked. The planar antenna 40 is therefore preferably located as close as possible to the dial 2 to improve reception performance. The circuit board 23 to which the planar antenna 40 is affixed is therefore also preferably close to the dial 2. Furthermore, because the storage battery 24 is thick, space can be used effectively and the electronic timepiece 1 can be made smaller by disposing the reception module 50, control unit 61, and power supply chip 75 on the back side (the back cover 12 side) of the circuit board 23.

Furthermore, because the reception module 50, control unit 61, and power supply chip 75 are located on the opposite side of the circuit board 23 as the planar antenna 40, digital noise produced by the reception circuit and power supply circuit cannot easily reach the planar antenna 40, and reception performance can be improved.

Furthermore, because the reception module 50, control unit 61, and power supply chip 75 are each surrounded by a shield 26, they are also shielded from noise produced by each other.

As shown in FIG. 5 and FIG. 6, the storage battery 24 is a lithium ion battery. The storage battery 24 supplies power to the drive module 22, reception module 50, and control unit 61. The storage battery 24 is also disposed in the notch 231 of the circuit board 23 at a position not overlapping the planar antenna 40, stepper motors 221 to 224, reception module 50, control unit 61, and power supply chip 75 in plan view.

The storage battery 24 does overlap part of the wheel trains 225, 227, and 228 in plan view. However, because the wheel trains 225, 227, and 228 are thin compared with the stepper motors 221 to 224, the electronic timepiece 1 can be made thinner by disposing the stepper motors 221 to 224 and planar antenna 40 so that they do not overlap in plan view even if the storage battery 24 overlaps the wheel trains 225, 227, and 228.

The surface electrode of the solar panel 25 is made from indium tin oxide (ITO) or other transparent electrode material to pass light. An amorphous silicon semiconductor thin film is formed as the photovoltaic layer on a plastic film base layer.

Because GPS satellite signals are high frequency signals of approximately 1.5 GHz, GPS signals are attenuated by even the thin transparent electrode of the solar panel, unlike the long wave standard time signals that are received by radio-controlled timepieces, and antenna performance drops. As a result, a notch 251 is formed in the disc-shaped solar panel 25 at the position overlapping the planar antenna 40 in plan view. The solar panel 25 therefore covers the face side of the base plate 21 but does not cover the planar antenna 40. The planar antenna 40 can therefore receive radio waves through the notch 251 in the solar panel 25.

Note that an opening 252 superimposed in plan view with the window 2B in the dial 2, a hole 253 through which the center pivot 3A of the hands 3 passes, and a hole 254 through which the pivot 4A of the small hand 4 passes, are also formed in the solar panel 25.

The solar panel 25 is divided into plural cells, and the cells are connected in series. As shown in FIG. 5, the solar panel 25 in this embodiment has seven solar cells, and the solar cells are connected in series. One solar cell produces approximately 0.6 V or more. By connecting the seven solar cells in series, the solar panel 25 therefore produces approximately 0.6 V×7=approximately 4.2 V or more. A lithium ion storage battery with a high EMF can therefore be charged, and devices with high current consumption, such as a GPS receiver (GPS module) can be driven.

The planar antenna 40, which is a patch antenna (microstrip antenna) is held in the antenna housing 21C. The planar antenna 40 can receive satellite signals from GPS satellites S. The planar antenna 40 is described further below.

The date wheel 5, which is a ring-shaped calendar wheel having date numbers displayed on the surface, is held in the date wheel housing 21B of the base plate 21. The date wheel 5 is made from plastic or other non-conductive material. In plan view, the date wheel 5 overlaps at least part of the planar antenna 40. Note that the calendar wheel is not limited to a date wheel 5, and may be a day wheel showing the days of the week, or a month wheel showing the months.

The dial 2 is disposed on the face side of the base plate 21 covering the face side of the solar panel 25 and the date wheel 5. The dial 2 is made from a material such as plastic that is non-conductive and transparent to at least some light.

Abbreviations or other markings can be disposed to the surface of the dial 2 overlapping the planar antenna 40 in plan view. To improve the reception performance of the planar antenna 40, these parts are preferably made from plastic or other non-conductive material instead of metal. The subdial 2A and markings thereof that are not located over the planar antenna 40 may be metal.

Because the dial 2 is transparent to light, the solar panel 25 located on the back side of the dial 2 can be seen through the dial 2 from the front of the timepiece. The color of the dial 2 therefore appears different in the areas where the solar panel 25 is present and where the solar panel 25 is not present. Design accents may be added to the dial 2 so that this color difference is not conspicuous.

Furthermore, because a notch 251 is formed in the solar panel 25, the color of the dial 2 in the area over the notch 251 may also appear different from other areas. To prevent this, a plastic sheet of the same color (such as dark blue or purple) as the solar panel 25 may be disposed below the solar panel 25, or the plastic film base layer may be left covering all of the solar panel 25, removing only the electrode layer that blocks radio waves in the part covering the planar antenna 40 in plan view.

A dial ring 32 that is a ring shaped member made of a plastic non-conductive material (such as ABS plastic) is disposed to the face side of the dial 2. The dial ring 32 is disposed around the circumference of the dial 2, is conically shaped with the inside circumference surface sloping down to the dial 2, and has hour markers or world time zone markers printed on the sloping inside surface. By molding the dial ring 32 from plastic, reception performance can be maintained, complicated shapes can be formed, and design creativity can be improved.

The dial ring 32 is held pressed against the dial 2 by the bezel 112. The time display unit 1A in this embodiment of the invention therefore has areas where the hands 3 and markers indicated by the hands 3 can be seen from the crystal 31 side, and more specifically includes an area on the dial 2 delineated by the dial ring 32, the hands 3, and an area delineated by the dial ring 32. In other words, the time display unit 1A comprises the round portion delineated by the inside circumference surface of the bezel 112 looking at the electronic timepiece 1 from the crystal 31 side.

Planar Antenna

In plan view, the planar antenna 40 is not superimposed with the main case 11 (outside case member 111 and bezel 112) and solar panel 25, and is superimposed with the date wheel 5, dial 2, and crystal 31 that are made from non-conductive materials. More specifically, all parts of the electronic timepiece 1 that are over the planar antenna 40 on the face side of the planar antenna 40 are made from non-conductive materials.

As a result, satellite signals travelling from the face side of the timepiece first pass through the crystal 31, pass through the dial 2, date wheel 5, and base plate 21 without being blocked by the main case 11 or the solar panel 25, and are then incident to the planar antenna 40. Note that because the area of the hands 3, 4 over the planar antenna 40 is small, they do not interfere with receiving satellite signals even if they are made of metal, but are preferably made from a non-conductive material because they will interfere with satellite signal reception even less.

The GPS satellites S transmit satellite signals as right-hand circularly polarized waves. As a result, the planar antenna 40 in this embodiment of the invention is a patch antenna (also called a microstrip antenna) with excellent circular polarization characteristics.

Figure 7:
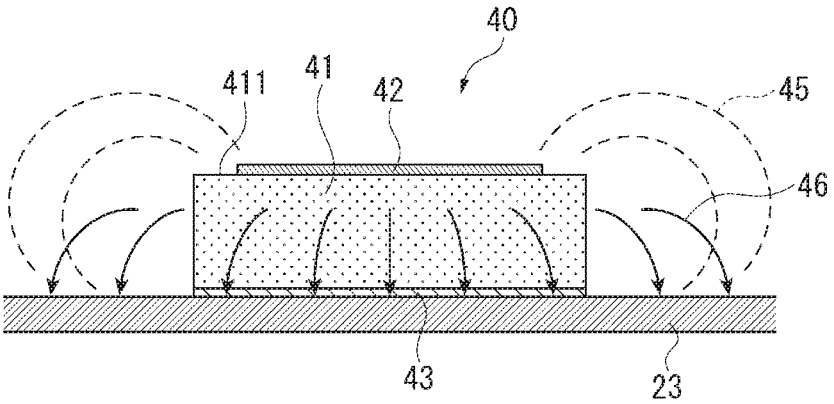
FIG. 7 is a section view illustrating the structure of the planar antenna in the electronic timepiece.

As shown in FIG. 7, the planar antenna 40 in this embodiment is a patch antenna having a conductive antenna electrode 42 stacked on a ceramic dielectric substrate 41.

This planar antenna 40 is manufactured as described below. First, barium titanate with a dielectric constant of 60-100 is formed to the desired shape in a press and sintered to complete the ceramic dielectric substrate 41 of the antenna. Aground electrode 43 forming the ground plane (GND) of the antenna is made by screen printing a primarily silver (Ag) paste, for example, on the back side (the side facing the circuit board 23) of the dielectric substrate 41.

A radiating antenna electrode 42 that determines the antenna frequency and the polarity of the received signals is formed on the face side of the dielectric substrate 41 (the side facing the base plate 21 and dial 2) by the same method as the ground electrode 43. The antenna electrode 42 is slightly smaller than the surface of the dielectric substrate 41, and an exposed surface 411 where the antenna electrode 42 is not present is disposed around the antenna electrode 42 on the surface of the dielectric substrate 41.

FIG. 7 illustrates the operating principle of a planar antenna 40 (patch antenna). In FIG. 7 the dotted lines 45 represent radio waves received by the planar antenna 40, and the arrows 46 represent the electric lines of force.

A square patch antenna resonates when one side is a half wavelength, and a round patch antenna resonates when the diameter is approximately 0.58 wavelength, but the size of the antenna size can be reduced by the wavelength shortening effect of a dielectric. A patch antenna works by the strong electric field around the edge of the patch (antenna electrode 42) radiating from the edge into space, and the electric lines of force become stronger with proximity to the antenna and are easily affected by the effects of nearby metals and dielectrics. To receive GPS satellite signals, therefore, the distance between the metal case member 111 and the antenna electrode 42 must be at least 3 mm, and is ideally approximately 4 mm.

In this example, the walls 214 are located between the planar antenna 40 and case member 111, and the planar antenna 40 is disposed to a position separated at least a specific distance from the inside surface of the case member 111. As a result, a drop in reception performance resulting from disposing the planar antenna 40 near the metal case member 111 can be suppressed, and the reception performance required by the electronic timepiece 1 can be assured.

Note also that the dielectric substrate 41 and antenna electrode 42 of the planar antenna 40 in this embodiment of the invention are substantially rectangular.

Figure 8:
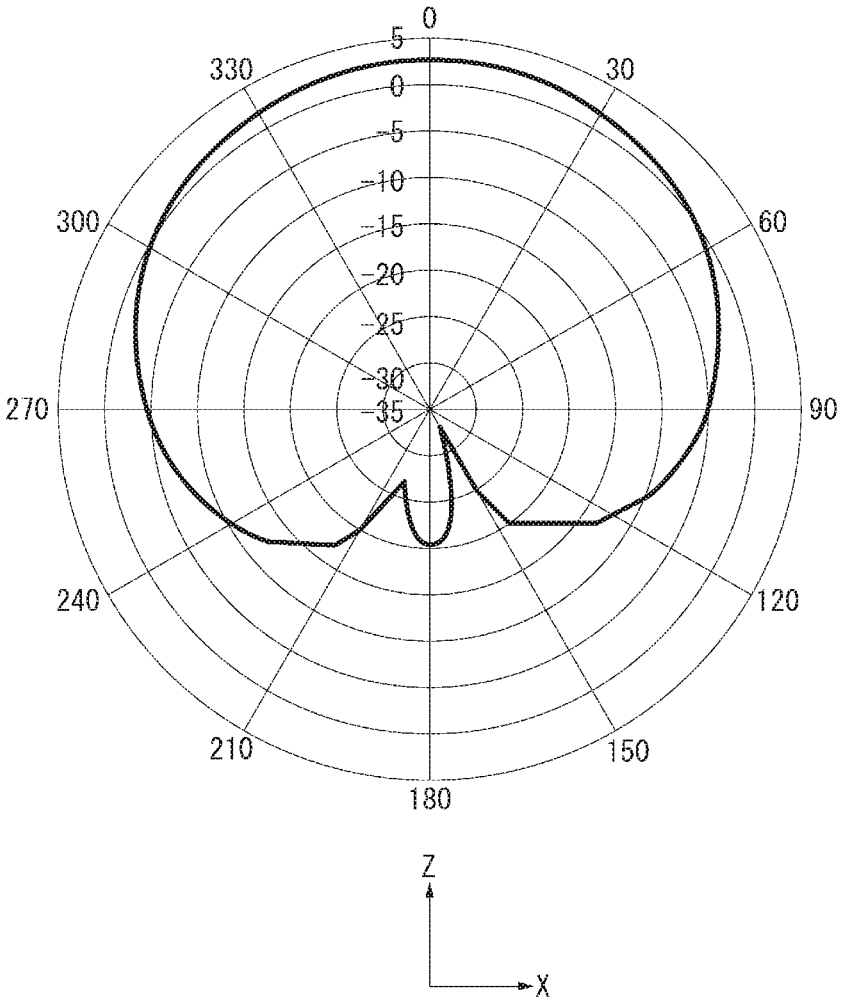
FIG. 8 illustrates the radiation pattern of the planar antenna in the electronic timepiece.

FIG. 8 illustrates the radiation pattern of the planar antenna 40, the plane of the planar antenna 40 (patch antenna) on the X-axis and the zenith on the Z-axis.

As shown in FIG. 8, because the directivity of the planar antenna 40 is greatest on the Z-axis toward the zenith, radio waves perpendicularly incident to the dial 2 are the easiest to receive. Furthermore, while directivity on the X-axis parallel to the plane of the planar antenna 40 is low compared with the Z-axis, because it is not totally absent, proximity of the metal main case 11 (case member 111) to the side of the planar antenna 40 also affects reception performance.

Furthermore, because directivity on the −Z-axis below the planar antenna 40 is weak, compared with an omnidirectional antenna having uniform directivity in all directions, metal parts and the back cover 12 located below the planar antenna 40 have little effect on reception performance.

Note also that because the electronic timepiece 1 according to the invention is worn on the user's wrist and may receive satellite signals from many different directions, the planar antenna 40 preferably has directivity in directions other than the zenith as shown in FIG. 8. Therefore, the directivity of the reception module 50 can be improved by making the bezel 112 and dial ring 32 from non-conductive materials.

The planar antenna 40 is mounted on the face side of the circuit board 23, and is electrically connected to the GPS module, which is the reception module 50, on the back side of the circuit board 23. The circuit board 23 can also function as a ground plane by connecting the ground electrode 43 of the planar antenna 40 through the ground pattern of the circuit board 23 to the ground node of the reception module 50. The case member 111 and back cover 12 can also be used as the ground plane by connecting the ground node of the reception module 50 through the ground pattern of the circuit board 23 to the metal case member 111 or back cover 12.

The planar antenna 40 is held in the antenna housing 21C by of the circuit board 23 to the base plate 21. Because the planar antenna 40 receives high frequency 1.54542 GHz signals, and includes a ceramic dielectric substrate 41 with a high dielectric constant, the planar antenna 40 is susceptible to the effects of surrounding parts. The base plate 21 is plastic, but has a dielectric constant of 3-4, and affects the reception frequency if the gap to the antenna electrode 42 is less than approximately 1.0 mm. More specifically, the antenna frequency may shift and reception performance drop if the gap between the base plate 21 and the antenna electrode 42 varies even slightly.

A sponge or other type of shock absorber 47 is therefore disposed between the exposed surface 411 of the planar antenna 40 and the cover part 215 in the antenna housing 21C of the base plate 21, thereby maintaining a constant gap between the antenna electrode 42 and the cover part 215. The ceramic dielectric substrate 41 is also hard and easily chipped, but contact between the dielectric substrate 41 and the base plate 21 can be prevented by the intervening shock absorber 47.

Part of the date wheel 5 is also disposed on the dial 2 side of the planar antenna 40. Because the antenna electrode 42 and date wheel 5 are separated by at least the thickness of the cover part 215, the date wheel 5 does not cause the antenna frequency to shift.

Circuit Configuration of the Electronic Timepiece

The circuit design of the electronic timepiece 1 is described next with reference to FIG. 9.

Figure 9:
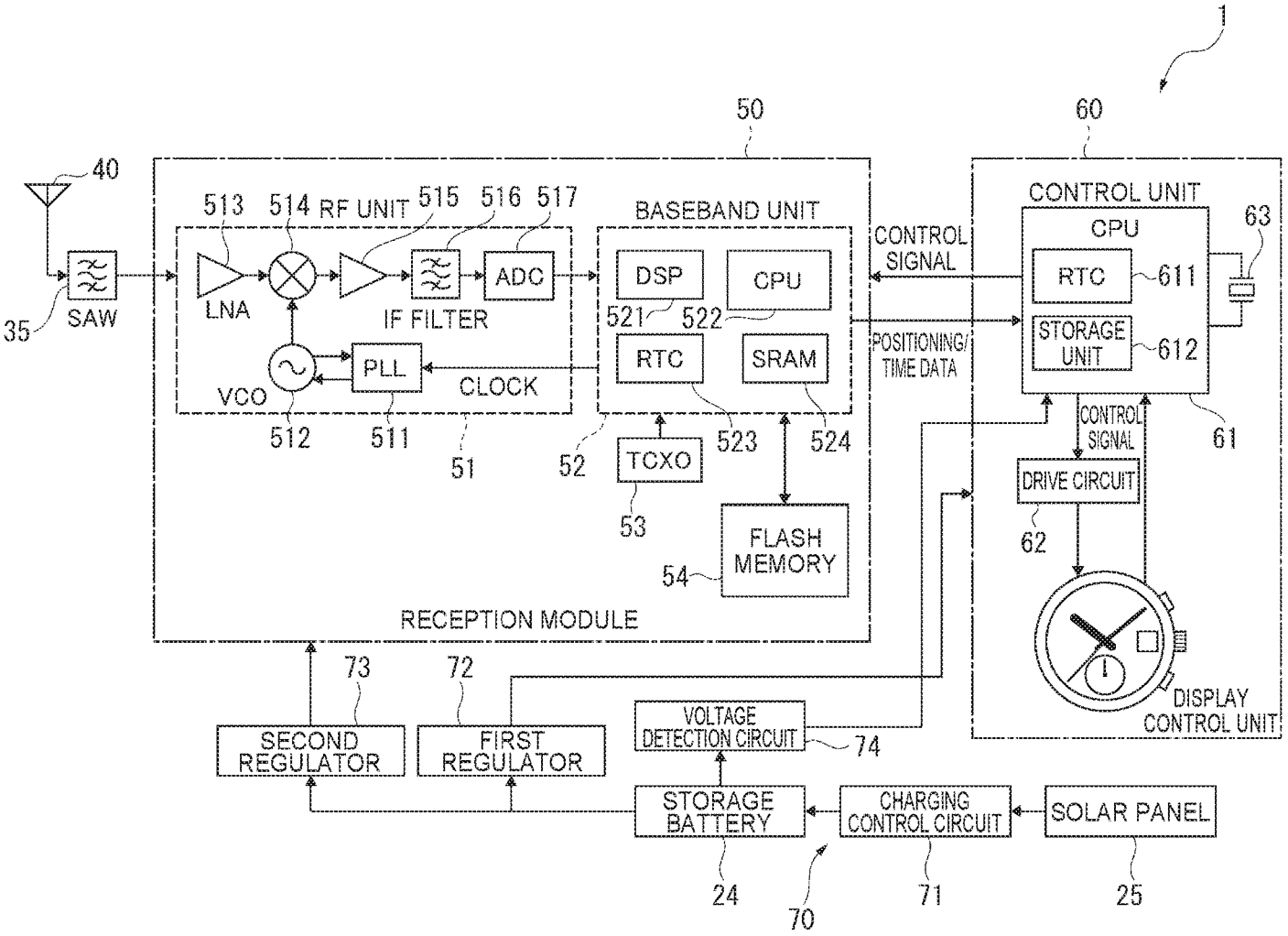
FIG. 9 is a block diagram showing the circuit design of the electronic timepiece.

As shown in FIG. 9, the electronic timepiece 1 has a planar antenna 40, a SAW filter 35, the reception module 50, a display control unit 60, and a power supply unit 70.

The SAW filter 35 is a bandpass filter that passes signals in the 1.5 GHz waveband. A LNA (low noise amplifier) may also be disposed between the planar antenna 40 and the SAW filter 35 to improve reception sensitivity.

Note also that the SAW filter 35 may be embedded in the reception module 50.

The reception module 50 processes satellite signals passed through the SAW filter 35, and includes an RF (radio frequency) unit 51 and a baseband unit 52.

The RF unit 51 includes a PLL (phase-locked loop) circuit 511, a VCO (voltage controlled oscillator) 512, a LNA (low noise amplifier) 513, a mixer 514, an IF (intermediate frequency) amplifier 515, an IF filter 516, and an A/D converter 517.

The satellite signal passed by the SAW filter 35 is amplified by the LNA 513, mixed by the mixer 514 with the clock signal output by the VCO 512, and down-converted to a signal in the intermediate frequency band.

The IF signal from the mixer 514 is amplified by the IF amplifier 515, passed through the IF filter 516, and converted to a digital signal by the A/D converter 517.

The baseband unit 52 includes, for example, a DSP (digital signal processor) 521, CPU (central processing unit) 522, a RTC (real-time clock) 523, and SRAM (static random access memory) 524. A TCXO (temperature compensated crystal oscillator) 53 and flash memory 54 are also connected to the baseband unit 52.

A digital signal is input from the A/D converter 517 of the RF unit 51 to the baseband unit 52, which acquires satellite time information and navigation information by a correlation process and positioning computation process.

Note that the clock signal for the PLL circuit 511 is generated by the TCXO 53.

The display control unit 60 includes a control unit (CPU) 61, a drive circuit 62 that drives the hands 3, 4, a time display unit, and information display unit.

The control unit 61 includes a RTC 611 and storage unit 612.

The RTC 611 calculates the internal time information using a reference signal output from a crystal oscillator 63.

The storage unit 612 stores the satellite time information and positioning information output from the reception module 50. Time difference data corresponding to the positioning information is also stored in the storage unit 612, and the local time at the current location can be calculated from the time difference data and the internal time kept by the RTC 611.

The electronic timepiece 1 in this example can also automatically correct the displayed time based on the satellite signals received from the GPS satellites S using the reception module 50 and display control unit 60 described above.

The power supply unit 70 includes the solar panel 25, a charging control circuit 71, the storage battery 24, a first regulator 72, a second regulator 73, and a voltage detection circuit 74.

When light is incident and the solar panel 25 produces power, the power obtained by photovoltaic generation is passed by the charging control circuit 71 to the storage battery 24 to charge the storage battery 24.

The storage battery 24 supplies drive power through the first regulator 72 to the display control unit 60, and supplies power through the second regulator 73 to the reception module 50.

The voltage detection circuit 74 monitors the output voltage of the storage battery 24, and outputs to the control unit 61. The control unit 61 can therefore control the reception process based on the voltage of the storage battery 24.

Operating Effect

The planar antenna 40, stepper motors 221 to 224, and storage battery 24 are disposed in the movement 20 of the electronic timepiece 1 at mutually different planar positions.

The three parts of the electronic timepiece 1 with the greatest thickness are therefore not disposed at the same positions in the thickness direction of the timepiece, and the electronic timepiece 1 can be made thinner than when the battery and planar antenna, for example, are disposed at overlapping positions in plan view.

The planar antenna 40, stepper motors 221 to 224, and storage battery 24 are also disposed at positions superimposed with the dial 2 and the hands 3 of the time display unit 1A in plan view. The plane size of the electronic timepiece 1 can therefore be easily reduced compared with a configuration having the planar antenna 40, stepper motors 221 to 224, and storage battery 24 outside of the footprint of the time display unit 1A in plan view. The size and thickness of the electronic timepiece 1 can therefore be easily reduced.

Because the planar antenna 40 can be disposed without overlapping the stepper motors 221 to 224 and storage battery 24 in plan view, the planar antenna 40 can be stacked on a dielectric substrate 41. As a result, good reception performance can be assured using a planar antenna 40 with a small planar size enabling incorporation in a wristwatch size electronic timepiece 1. Furthermore, while the planar antenna 40 overlaps the dial 2 of the time display unit 1A in plan view, the reception performance of the planar antenna 40 can be assured because the dial 2 is made from a non-conductive material. The effect of the hands 3 on reception performance can also be minimized even if the hands 3 are made of a conductive material because the plane area of the hands is small.

Reception performance can therefore be assured, and a thin electronic timepiece suitable as a wristwatch can be provided.

The plane area of the base plate 21 is divided into a first area 201 and second area 202, two stepper motors 221 and 224 are disposed in the first area 201, and two stepper motors 222 and 223 are disposed in the second area 202. The four stepper motors 221 to 224 can therefore be disposed in a well-balanced configuration in the first area 201 and second area 202, and the layout of the planar antenna 40, storage battery 24, and stepper motors 221 to 224 can be simplified.

Furthermore, because the planar antenna 40 and storage battery 24 are disposed so that a line 200 through center points 241 and 401 passes through the plane center of the base plate 21 and dial 2, the planar antenna 40 and storage battery 24 can be disposed with the greatest separation therebetween in areas superimposed with the dial 2 and base plate 21 in plan view. The effect of the storage battery 24 with a metal case on reception by the planar antenna 40 can therefore be minimized, and good reception performance can be easily assured.

Furthermore, because the switching mechanism including the stem 81 and setting lever 82 are disposed at the 3:00 position of the dial 2 in plan view, the plane size of the electronic timepiece 1 necessarily increases if the planar antenna 40 and storage battery 24, which are among the largest parts of the timepiece, are located at 3:00. However, because the planar antenna 40 and storage battery 24 are not located at 3:00 in this embodiment of the invention, they do not interfere with the layout of the switching mechanism at the 3:00 position, and the plane size of the electronic timepiece 1 can be reduced.

Furthermore, because the storage battery 24 is located in a notch 231 in the circuit board 23, the thickness of the electronic timepiece 1 can be reduced compared with a configuration having the battery on the back side of the circuit board 23, and a thin electronic timepiece 1 can be provided. Furthermore, because there is no need to dispose the storage battery 24 on the back side of the circuit board 23, a thick battery with a small plane area can be used. A small electronic timepiece 1 can therefore be achieved even if the battery is disposed to a position not overlapping the planar antenna 40 or stepper motors 221 to 224 in plan view.

Because the reception module 50 is disposed on the back side of the circuit board 23, and the circuit board 23 is between the reception module 50 and the planar antenna 40, the circuit board 23 can be used as the ground plane of the planar antenna 40. As a result, signal noise produced by the reception module 50 is prevented from affecting reception of satellite signals by the planar antenna 40, and the reception performance of the planar antenna 40 can be improved.

Furthermore, because the reception module 50, control unit 61, and power supply chip 75 are disposed on the back side of the circuit board 23, the space between the circuit board 23 and the back cover 12 where other parts are not disposed can be used effectively. The reception module 50, control unit 61, and power supply chip 75, which are relatively large parts, can be easily incorporated in an electronic timepiece 1 that is a wristwatch.

Furthermore, because the reception module 50 overlaps the planar antenna 40 in plan view, the control unit 61 is in the second area 202, and the power supply chip 75 is in the first area 201, these devices can be distributed on the back side of the circuit board 23. There is therefore no need to dispose IC chips on the face side of the circuit board 23, and space for the planar antenna 40, stepper motors 221 to 224, and wheel trains 225, 227, and 228 can be assured on the face side of the circuit board 23.

The appearance of the electronic timepiece 1 can also be improved because part of the case 10, such as the outside case member 111 and back cover 12, are metal. Furthermore, because the ring members including the dial ring 32 disposed around the outside circumference of the dial 2 are made from non-conductive materials, the planar antenna 40 can receive satellite signals passing from the crystal 31 side of the timepiece through the dial 2, dial ring 32, and base plate 21, and good reception performance can be assured even though the outside case member 111 and back cover 12 are metal.

Furthermore, because the subdial 2A is disposed to a position not overlapping the planar antenna 40 in plan view, metal parts can be used for the markers of the subdial 2A, for example, and the design can be improved.

Furthermore, because a shock absorber 47 is placed between the cover part 215 of the base plate 21 and the exposed surface 411 of the dielectric substrate 41, and the exposed surface 411 of the planar antenna 40 is set against the shock absorber 47, the planar antenna 40 can be precisely positioned in the height (thickness) direction of the electronic timepiece 1. As a result, the positioning precision of the planar antenna 40 to the base plate 21 can be improved, change in the antenna frequency due to deviation in positioning precision can be further reduced, and antenna performance can be further stabilized.

Furthermore, because the exposed surface 411 of the planar antenna 40 contacts the shock absorber 47, direct contact with the cover part 215 can be prevented, and damage to the ceramic dielectric substrate 41 can be prevented.

Furthermore, because the date wheel 5 is made from a non-conductive material, a drop in reception performance can be prevented even if the date wheel 5 overlaps the planar antenna 40 in part in plan view because the satellite signals can pass through the date wheel 5 to the antenna.

Furthermore, because the date wheel 5 overlaps the planar antenna 40 in plan view, there is greater freedom positioning the center pivot 3A and pivot 4A of the hands 3 and small hand 4 to avoid the date wheel 5 and planar antenna 40, and the electronic timepiece 1 can be designed with a greater degree of freedom.

Furthermore, because the planar antenna 40 does not overlap the solar panel 25 in plan view, satellite signals passing from the face side of the timepiece are incident to the planar antenna 40 without being obstructed by the solar panel 25. A solar panel 25 can therefore be used in the electronic timepiece 1 without reducing reception performance.

Because the planar antenna 40 does not overlap the main case 11 (outside case member 111 and bezel 112) in plan view when seen from the face of the timepiece, satellite signals pass from the face side of the timepiece through the crystal 31 and are incident to the planar antenna 40 without interference from the main case 11. Metal or other conductive material can therefore be used for the main case 11 and back cover 12 without reducing reception performance, and the apparent quality of the electronic timepiece 1 can be improved.

Furthermore, because the bezel 112 is made from a conductive material, the bezel 112 can be manufactured more easily than when using ceramic, freedom of design can therefore be improved, and cost can be reduced. Furthermore, because the bezel 112 is metal, greater rigidity can be achieved in a smaller sectional area than with a ceramic bezel. The sectional width of the ring-shaped bezel 112 can therefore be reduced, the planar size of the crystal 31 can be increased, and the freedom of timepiece design can be improved.

The outside case member 111 and back cover 12 can also function as a ground plane because they are connected to the ground of the reception module 50. The surface area of the ground plane can therefore be increased, antenna gain improved, and antenna performance improved.

Embodiment 2

A second embodiment of the invention is described next with reference to FIG. 10 to FIG. 12. Note that like parts in the second embodiment and the first embodiment are identified by like reference numerals, and further description thereof is omitted.

The electronic timepiece 100 according to the second embodiment of the invention differs from the first embodiment in that the number of stepper motors and the number of pivots are greater than in the first embodiment, and by using a storage battery 24A with a small planar size, the storage battery 24A is disposed to a position not overlapping the stepper motors 221 to 224, the planar antenna 40, or the wheel trains 225, 227, and 228 in plan view.

Figure 11:
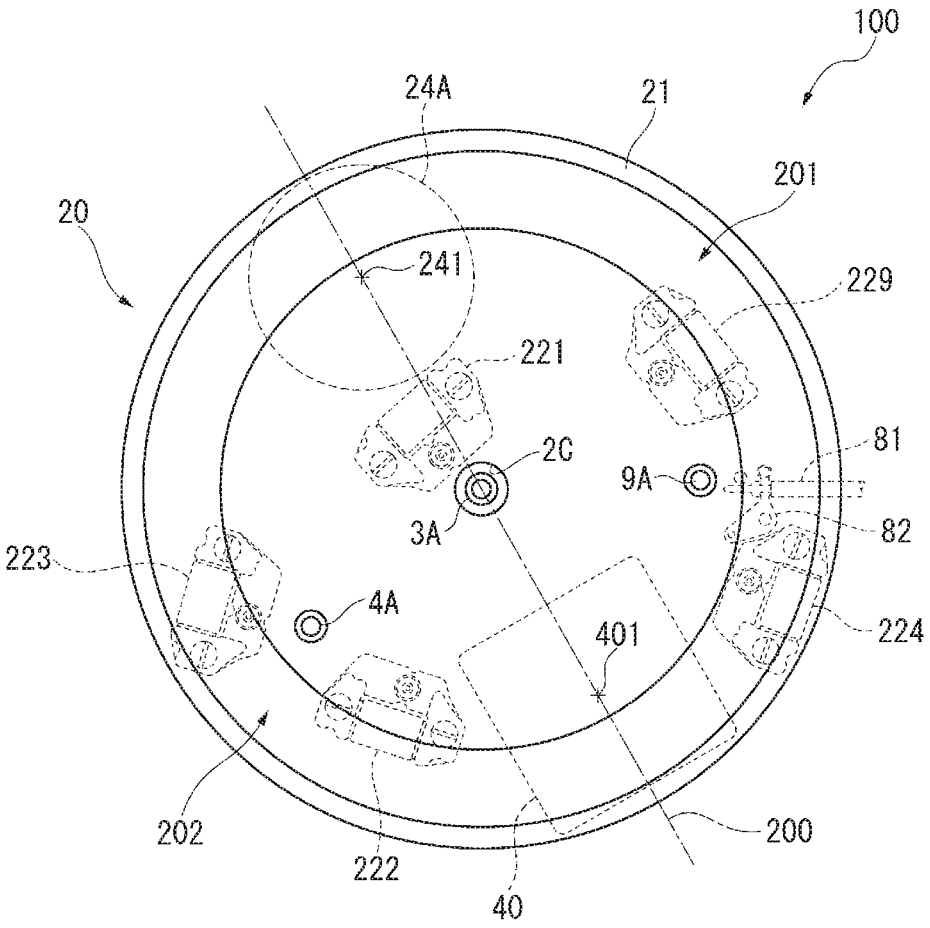
FIG. 11 is a plan view showing main parts of the movement of the electronic timepiece according to the second embodiment of the invention.

As shown in FIG. 11, the second embodiment has a pivot 9A disposed at a different planar position than pivot 3A and pivot 4A, and a fifth stepper motor 229 that drives the pivot 9A is added.

Figure 10:
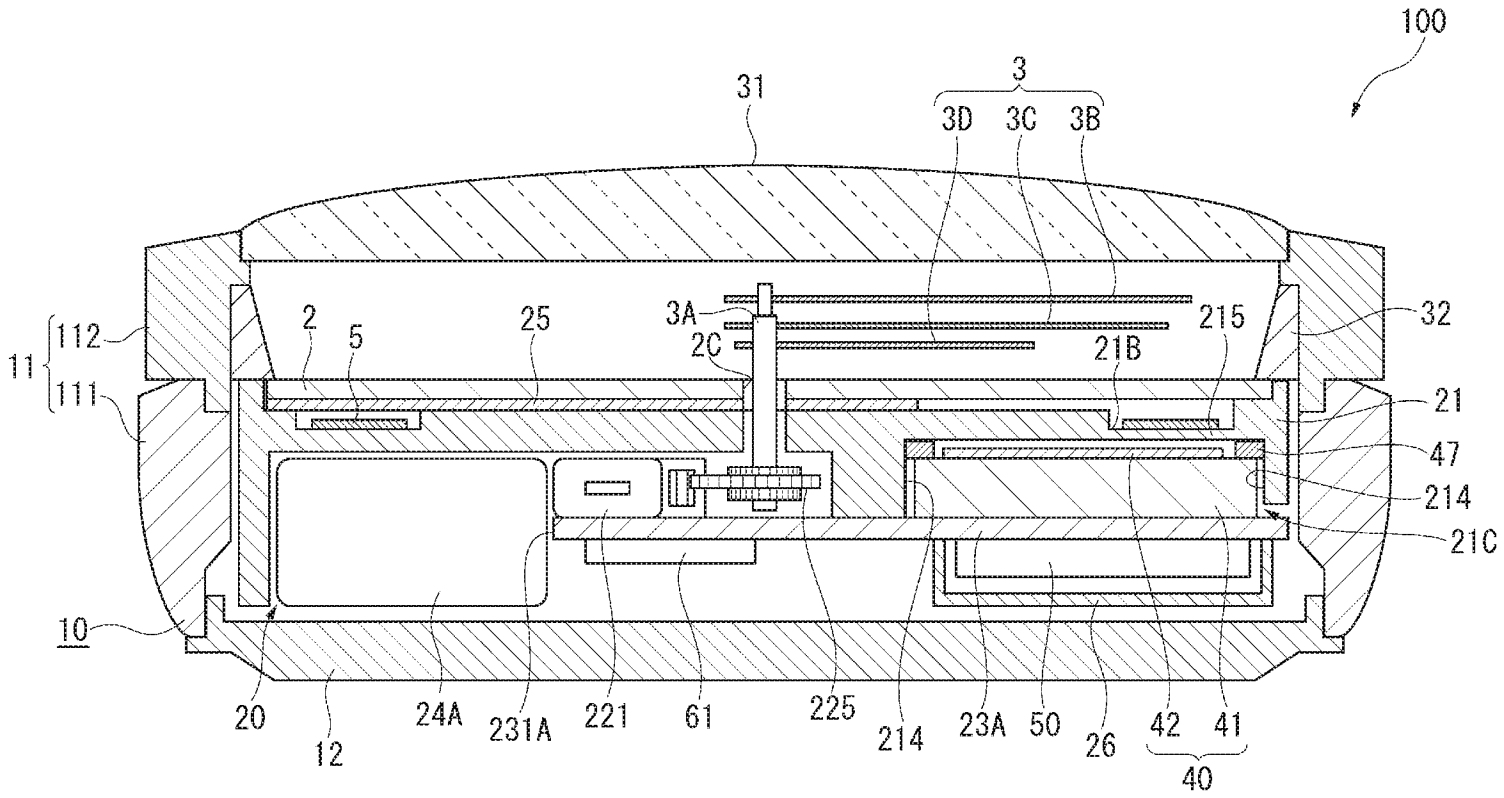
FIG. 10 is a section view of an electronic timepiece according to a second embodiment of the invention.

More specifically, the first stepper motor 221 and first wheel train 225 that drive the hour hand 3D and minute hand 3C of the hands 3 are disposed near center pivot 3A as shown in FIG. 10 and FIG. 11.

The second stepper motor 222 and second wheel train (not shown in the figure) that drive the second hand 3B of the hands 3, the third stepper motor 223 and third wheel train (not shown in the figure) that drive the hand 4, and the fourth stepper motor 224 and fourth wheel train (not shown in the figure) that drive the date wheel 5, are disposed to the same positions as in the first embodiment.

Pivot 9A in the second embodiment is disposed to a different planar position than the center pivot 3A and pivot 4A. The fifth stepper motor 229 and a fifth wheel train (not shown in the figure) that drive the pivot 9A are also provided.

The fourth stepper motor 224 and fifth stepper motor 229 are disposed in the first area 201, and the second stepper motor 222 and third stepper motor 223 are disposed in the second area 202, in this second embodiment. The first stepper motor 221 is disposed across the boundary between the first area 201 and second area 202.

As shown in FIG. 11, the stem 81 is at the 3:00 position of the electronic timepiece 1, and a switching mechanism including the setting lever 82 is disposed around the stem 81.

This second embodiment uses a storage battery 24A with a smaller plane size than the storage battery 24 of the first embodiment. More specifically, the diameter of the storage battery 24 in the first embodiment, as shown in FIG. 6, is greater than the radius of the base plate 21 of the movement 20, which is approximately the same size as the time display unit 1A. The diameter of the storage battery 24A in the second embodiment is smaller than the radius of the base plate 21 of the movement 20 as shown in FIG. 11. As a result, the storage battery 24A is disposed in an area overlapping the time display unit 1A in plan view between the center pivot 3A in the plane center of the time display unit 1A and the outside edge of the time display unit 1A.

As a result, while the storage battery 24 in the first embodiment is a coin lithium battery 20 mm in diameter and 1.6 mm thick, the storage battery 24A in the second embodiment is a lithium battery 9 mm in diameter and 3.7 mm thick.

Because the storage battery 24A is smaller in diameter than the storage battery 24 in the first embodiment, the size of the notch 231A where the storage battery 24A is located in the circuit board 23A can also be reduced. The storage battery 24A can also be disposed to a position not overlapping the planar antenna 40, first stepper motor 221 to fifth stepper motor 229, and the first wheel train 225 to fifth wheel train in plan view.

More specifically, while the storage battery 24 is disposed to directly below the center pivot 3A of the hands 3 in the first embodiment, the storage battery 24A in the second embodiment can be disposed without overlapping pivots 3A, 4A and 9A in plan view.

Figure 12:
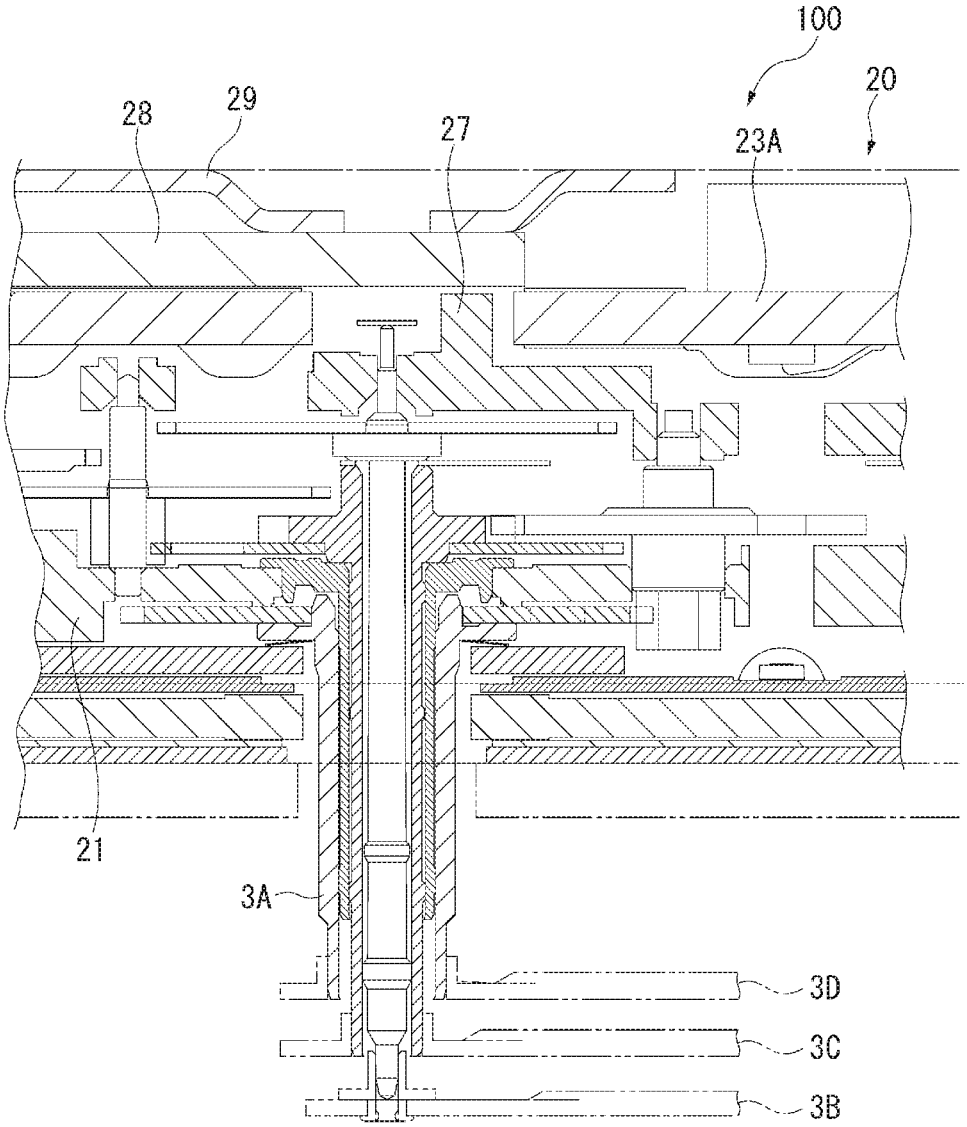
FIG. 12 is a section view of part of the electronic timepiece according to the second embodiment of the invention.

Because the storage battery 24A does not overlap the first to fifth wheel trains in this electronic timepiece 100, as shown in FIG. 12, a magnetic shield 28 and a circuit cover 29 can be disposed on the back cover 12 side of the wheel train bridge 27 that supports the center pivot 3A of the hands 3. In addition to the center pivot 3A, the storage battery 24A also does not overlap in plan view the wheel train bridge 27 that supports pivots 4A and 9A. As a result, a magnetic shield 28 and a circuit cover 29 can be disposed on the back cover 12 side of the wheel train bridge 27 that supports pivots 4A and 9A.

Because the diameter of the storage battery 24A is small in the electronic timepiece 100 according to the second embodiment of the invention, the notch 231A in the circuit board 23A can also be small. As a result, the area of the circuit board 23A can be increased compared with the circuit board 23 in the first embodiment, there is greater freedom in the wiring design, and an ideal wiring pattern can be achieved. Because the ground area of the circuit board 23A also increases, the reception performance of the planar antenna 40 can be improved.

Because the plane size of the storage battery 24A is small, the size of the electronic timepiece 100 can also be reduced even if the storage battery 24A is disposed in the movement 20 at a position not overlapping the planar antenna 40, first stepper motor 221 to fifth stepper motor 229, and first wheel train 225 to fifth wheel train in plan view. The size of the electronic timepiece 100 can also be reduced because the storage battery 24A and planar antenna 40 are disposed to positions not interfering with the switching mechanism including the stem 81 and setting lever 82 at the 3:00 position.

Furthermore, when the second hand 3B, minute hand 3C, and hour hand 3D are pressed onto the center pivot 3A, the force transferred from the center pivot 3A to the wheel train bridge 27 can be supported by the magnetic shield 28 and circuit cover 29. Because the magnetic shield 28 and circuit cover 29 are metal and have high strength, they can bear the pressure used to push the hands onto the center pivot 3A, and the hands can be installed with greater reliability.

The magnetic shield 28 and circuit cover 29 can also be disposed on the back cover side of the pivots 4A and 9A, the force used to push hands onto the pivots 4A and 9A can be supported by these metal parts, and the hands can be installed with greater reliability.

The small diameter storage battery 24A can also be disposed remotely to the planar antenna 40. As a result, the storage battery 24A can be located at a position removed from the feed pin, and its effect on reception sensitivity can be suppressed.

Furthermore, while high output storage batteries such as coin lithium ion batteries increase in thickness over time, the wheel trains and other parts are not affected by this increase in thickness because they do not overlap the storage battery 24A in plan view.

Other Embodiments

The invention is not limited to the embodiments described above, and can be modified and improved in many ways without departing from the scope of the accompanying claims.

Figure 13:
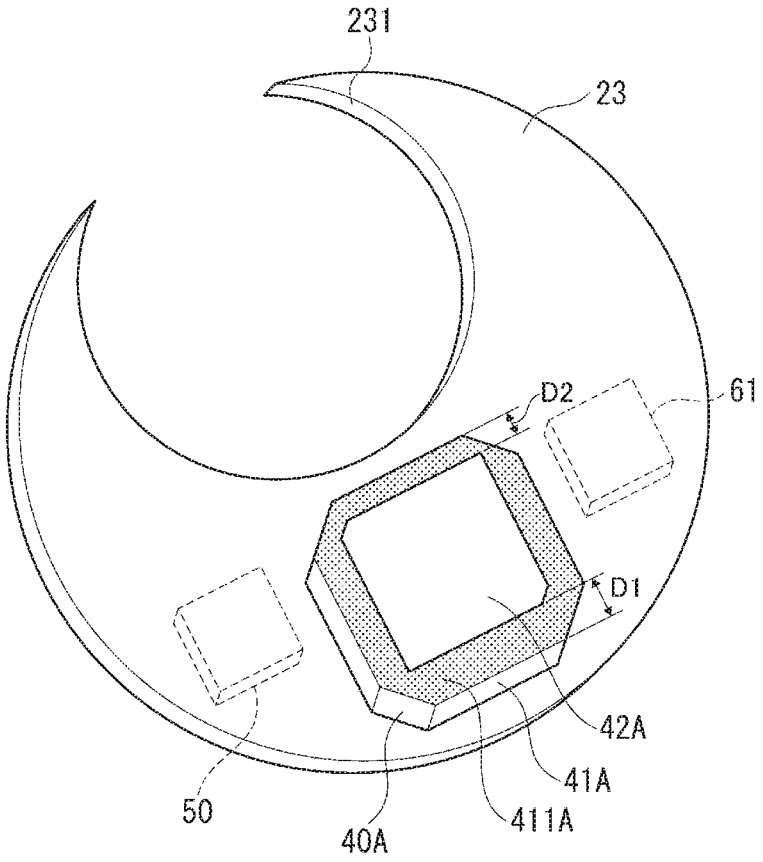
FIG. 13 illustrates the circuit board and planar antenna of the electronic timepiece according to another embodiment of the invention.

The configuration of the planar antenna and the circuit board are not limited to the foregoing examples, and a planar antenna 40A such as shown in FIG. 13 may be used.

This planar antenna 40A has the antenna electrode 42A disposed on the surface of the dielectric substrate 41A shifted toward the planar center of the circuit board 23, that is, toward the planar center of the electronic timepiece 1. As a result, in the exposed surface 411A of the surface of the dielectric substrate 41A, the width D1 of the exposed surface 411A from the antenna electrode 42A to the outside case member 111 side is greater than the width D2 of the exposed surface 411A from the antenna electrode 42A to the side near the planar center of the circuit board 23A. More specifically, the planar center of the antenna electrode 42A is offset from the planar center of the dielectric substrate 41A, and is closer to the planar center of the electronic timepiece 1 than the planar center of the dielectric substrate 41A.

In plan view, the width D1 can also be expressed as the distance from the side of the antenna electrode 42A closest to the outside case member 111 to the side of the dielectric substrate 41A closest to the outside case member 111. Width D2 can also be expressed as the distance from the side of the antenna electrode 42A closest to the planar center of the electronic timepiece 1 to the side of the dielectric substrate 41A closest to the planar center of the electronic timepiece 1.

By disposing the planar antenna 40A with the antenna electrode 42A separated from the metal outside case member 111, the radio frequency shielding effect of the metal outside case member 111 can be reduced.

Figure 14:
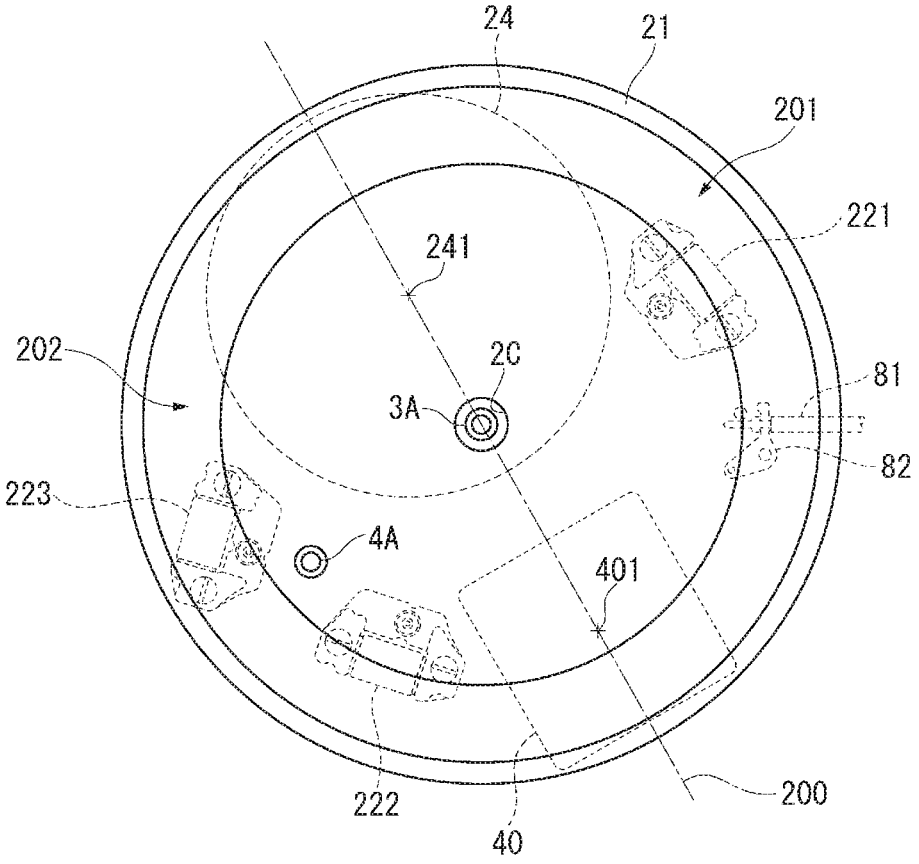
FIG. 14 is a plan view showing main parts of the movement in another embodiment of the invention.

Two of the four stepper motors 221 to 224 are disposed in the first area 201 and two are disposed in the second area 202 in the first embodiment, but when there are three motors, first stepper motor 221, second stepper motor 222, and third stepper motor 223, as shown in FIG. 14, two may be disposed in the first area 201 or the second area 202 and the remaining one in the other area.

When there are five motors, the arrangement is not limited to that shown in the second embodiment, and three may be disposed in the first area 201 or the second area 202 and the remaining two in the other area.

More specifically, when there are plural motors, the motors are preferably distributed between the first area 201 and second area 202, the same number of motors is preferably disposed in the first area 201 and second area 202 when there is an even number of motors, and when there is an odd number of motors, the motors are preferably arranged so that the difference between the number in the first area 201 and second area 202 is one.

The invention is also not limited to distributing plural motors between two areas 201, 202. For example, when the storage battery 24 and planar antenna 40 are disposed so that the line connecting their planar centers does not pass through the center of the dial 2, the surface areas of the two areas divided by this line differ. In this event, all of the plural motors may be disposed in the larger area. The motors may also be arranged so that the difference in the number of motors in each area is two or more.

When a storage battery 24A with a small diameter is used as in the second embodiment, the line 200 through the plane center 401 of the planar antenna 40 and the plane center 241 of the storage battery 24A is not limited to also passing through the center of the base plate 21 as with the arrangement of the planar antenna 40 and storage battery 24A shown in FIG. 11.

Figure 15:
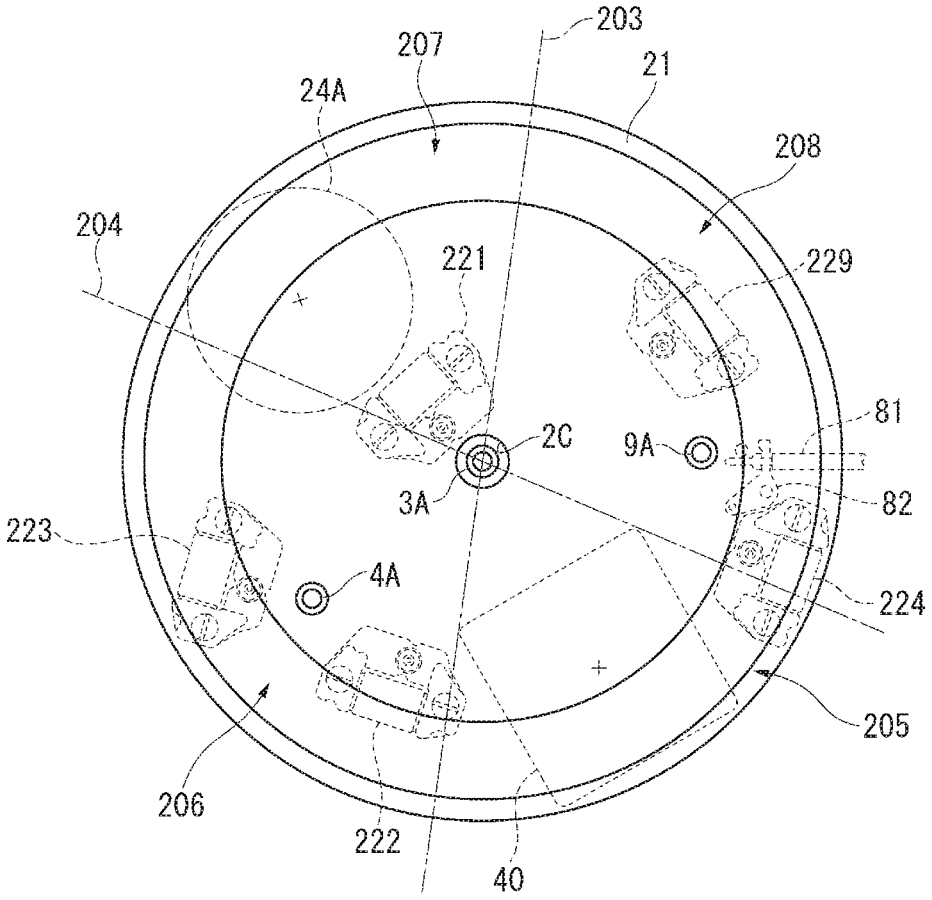
FIG. 15 is a plan view showing main parts of the movement in another embodiment of the invention.

For example, as shown in FIG. 15, the area including the time display unit 1A in plan view may be divided into four fan-shaped areas 205 to 208, first fan-shaped area 205 to fourth fan-shaped area 208, by two lines 203, 204 each passing through the center of the base plate 21 (time display unit 1A). The planar antenna 40 is in the first fan-shaped area 205. In this configuration, the lines 203, 204 are set so that the first fan-shaped area 205 is the smallest area required to include all of the planar antenna 40.

At least part of the storage battery 24A is also disposed in the third fan-shaped area 207 located on the opposite side of the base plate 21 as the first fan-shaped area 205. Because the plane center of the round storage battery 24A is located inside the third fan-shaped area 207 in the configuration shown in FIG. 15, half of the surface area of the storage battery 24A is located in the third fan-shaped area 207. The majority of the storage battery 24A is therefore located in the third fan-shaped area 207, and part of the storage battery 24A is in the second fan-shaped area 206 in FIG. 15.

Because the planar antenna 40 is in the first fan-shaped area 205 and the storage battery 24A is in the opposite third fan-shaped area 207, space inside the movement 20 can be used effectively.

The main case 11 in the foregoing embodiments includes a outside case member 111 and bezel 112, but the invention is not so limited. More specifically, the main case 11 may comprise only the outside case member 111.

The bezel 112 in the foregoing embodiment is made from a conductive material, but the invention is not so limited. For example, the bezel 112 may be made of a ceramic such as zirconia ($ZrO_2$), which is a non-conductive material. Zirconia has high resistivity, does not adversely affect signal reception, is hard, offers excellent scratch resistance, and is outstanding when used as an external member of a timepiece. If the bezel 112 is ceramic, the bezel 112 and the antenna electrode 42 can overlap in plan view. As a result, there is no need to increase the diameter of the outside case member 111 so that the bezel 112 does not overlap the antenna electrode 42 in plan view, the diameter of the outside case member 111 can be reduced, and the plane size of the electronic timepiece 1 can be reduced.

The electronic timepiece 1 in the foregoing embodiment has a date wheel 5, solar panel 25, and dial ring 32, but the invention is not so limited. More specifically, the electronic timepiece may be made without a date wheel 5, solar panel 25, or dial ring 32.

The outside case member 111 and back cover 12 touch the ground of the reception module 50 in the foregoing embodiments, but the invention is not so limited. More specifically, the outside case member 111 and back cover 12 do not need to connect to the ground.

The electronic timepiece in the foregoing embodiments has a time display unit 1A comprising a dial 2 and hands 3, but the invention is not so limited. The electronic timepiece may be made with an LCD panel as the time display unit, for example. In this event, the drive module that drives the time display unit may be a drive unit that drives the LCD panel.

In this case, the electronic timepiece simply requires a time display function, and the time display unit need not be a display unit that only displays the time. Examples of such electronic timepieces are wrist-wearable devices such as heart rate monitors that are worn on the user's wrist to measure the heart rate, and GPS loggers that are worn on the wrist and log the user's current location while the user is jogging.

The foregoing embodiments are described with reference to a GPS satellite as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China). The invention can also be used with geostationary satellites in satellite-based augmentation systems (SBAS), and quasi-zenith satellites in radio navigation satellite systems (RNSS) that can only search in specific regions. The invention can also be used in configurations that receive and process satellite signals from multiple systems.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An electronic timepiece comprising:

a time display unit including:

a dial made from a non-conductive material, the dial having a planar center, and hands;

a movement that drives the hands, the movement including:

a circuit board;

a planar antenna attached to the circuit board;

a motor that drives the hands; and a battery;

a case having an opening; and a cover member covering the opening of the case such that the cover member and case enclose the movement and the time display within the case, the cover member having a planar center that is the same as the planar center of the dial, wherein the planar antenna, the motor, and the battery are disposed overlapping the time display unit in a plan view, and not overlapping each other in the plan view, the hands include an hour hand, a minute hand, and a second hand, and each of the hour hand, the minute hand and the second hand has a pivot, a hole through which the pivots of the hour hand, the minute hand, and the second hand pass is formed in the planar center of the dial, the movement further includes a wheel train that transfers drive power from the motor to the hands, the battery is disposed at a position not overlapping the wheel train in the plan view, and the planar antenna is disposed at a position not overlapping the wheel train in the plan view.

2. The electronic timepiece described in claim 1, wherein:

the movement has a plurality of motors; and at least one of the plurality of motors is disposed between the battery and the hole.

3. The electronic timepiece described in claim 1, wherein:

a notch is formed in the circuit board; and the battery is disposed in the notch at a position not overlapping the circuit board in the plan view.

4. The electronic timepiece described in claim 1, wherein:

the movement has a plurality of pivots disposed at different positions in the plan view; and the pivots are disposed at positions not overlapping the planar antenna and the battery in the plan view.

5. The electronic timepiece described in claim 1, wherein:

the movement is housed in an outside case, at least a part of the outside case is metal; and a ring member made from a non-conductive material is disposed entirely around an outside circumference of the dial.

6. The electronic timepiece described in claim 1, wherein:

a subdial is disposed on the dial at a position not overlapping the planar antenna in the plan view.

7. An electronic timepiece comprising:

a time display unit including a dial made from a non-conductive material, and hands;

a movement that drives the hands, the movement including:

a circuit board having a back;

a planar antenna attached to the circuit board, the planar antenna having a first planar center;

a motor that drives the hands; and a battery, the battery having a second planar center;

a case having an opening; and a cover member covering the opening of the case such that the cover member and case enclose the movement and the time display within the case, the cover member having a planar center that is the same as the planar center of the dial, wherein the planar antenna, the motor, and the battery are disposed overlapping the time display unit in a plan view, and not overlapping each other in the plan view, the planar antenna is attached to a surface of the circuit board; a hole through which pivots of the hand pass is formed in a planar center of the dial; and a control chip of the electronic timepiece is attached to the back of the circuit board in a first of two areas delineated by a line passing through the first planar center of the planar antenna and the second planar center of the battery, and a power supply chip is attached to the back of the circuit board in a second of the two areas.

8. The electronic timepiece described in claim 7, wherein:

a notch is formed in the circuit board; and the battery is disposed in the notch at a position not overlapping the circuit board in the plan view.

9. The electronic timepiece described in claim 7, wherein:

the movement has a plurality of pivots disposed at different positions in the plan view; and the pivots are disposed at positions not overlapping the planar antenna and the battery in the plan view.

10. The electronic timepiece described in claim 7, wherein:

the movement is housed in an outside case, at least a part of the outside case is metal; and a ring member made from a non-conductive material is disposed entirely around an outside circumference of the dial.

11. The electronic timepiece described in claim 7, wherein:

a subdial is disposed to the dial at a position not overlapping the planar antenna in the plan view.

* * * * *